US008814537B2

(12) United States Patent
Ignatiev et al.

(10) Patent No.: US 8,814,537 B2
(45) Date of Patent: Aug. 26, 2014

(54) DIRECT-SUCTION COMPRESSOR

(75) Inventors: Kirill Ignatiev, Sidney, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 13/610,274

(22) Filed: Sep. 11, 2012

(65) Prior Publication Data

US 2013/0081710 A1 Apr. 4, 2013

Related U.S. Application Data

(60) Provisional application No. 61/541,494, filed on Sep. 30, 2011.

(51) Int. Cl.
*F04C 29/12* (2006.01)
*F04B 39/06* (2006.01)

(52) U.S. Cl.
USPC ..... 417/366

(58) Field of Classification Search
CPC ..... F04C 29/04; F04C 29/044; F04C 29/12; F04B 39/123
USPC ..... 417/292, 366, 368, 371; 62/505
See application file for complete search history.

(56) References Cited

U.S. PATENT DOCUMENTS 4,313,715 A 2/1982 Richardson, Jr.
4,343,599 A 8/1982 Kousokabe
4,365,941 A 12/1982 Tojo et al.
4,412,791 A 11/1983 Lal
4,496,293 A 1/1985 Nakamura et al.
4,564,339 A 1/1986 Nakamura et al.
4,592,703 A 6/1986 Inaba et al.
4,609,334 A 9/1986 Muir et al.
4,696,629 A 9/1987 Shiibayashi et al.
4,759,696 A 7/1988 Ishiai
4,793,775 A * 12/1988 Peruzzi ..... 417/312

(Continued)

FOREIGN PATENT DOCUMENTS

JP 08319965 A 12/1996
JP 2010043627 A 2/2010
WO WO-2007114582 A1 10/2007
WO 2011147005 A1 12/2011

OTHER PUBLICATIONS

International Search Report regarding Application No. PCT/US2012/056067, mailed Feb. 19, 2013.

(Continued)

*Primary Examiner* — Nathan Zollinger
(74) *Attorney, Agent, or Firm* — Harness, Dickey & Pierce, P.L.C.

(57) ABSTRACT

A compressor may include a shell, a compression mechanism, and a suction passageway. The shell may include an inlet port. The compression mechanism may be disposed within the shell and may include a suction inlet. The suction passageway may include a first portion, a second portion, and an intermediate portion. The first portion may be fluidly coupled to the inlet port. The second portion may be fluidly coupled to the suction inlet of the compression mechanism. The intermediate portion may be disposed between the first and second portions and may be movable between a first position in which the intermediate portion engages the first and second portions and a second position in which the intermediate portion is disengaged from at least one of the first and second portions.

27 Claims, 6 Drawing Sheets

(56) References Cited

U.S. PATENT DOCUMENTS

| | | | | |
|---|---|---|---|---|
| 4,838,769 | A | 6/1989 | Gannaway | |
| 5,007,809 | A | 4/1991 | Kimura et al. | |
| 5,114,322 | A | 5/1992 | Caillat et al. | |
| 5,219,281 | A | 6/1993 | Caillat et al. | |
| 5,240,391 | A | 8/1993 | Ramshankar et al. | |
| 5,306,126 | A | 4/1994 | Richardson, Jr. | |
| 5,366,352 | A | 11/1994 | Deblois et al. | |
| 5,435,700 | A | 7/1995 | Park | |
| 5,531,078 | A | 7/1996 | Day et al. | |
| 5,533,875 | A | 7/1996 | Crum et al. | |
| 5,772,411 | A | 6/1998 | Crum et al. | |
| 6,000,917 | A | 12/1999 | Smerud et al. | |
| 6,131,406 | A * | 10/2000 | Barowsky et al. | 62/505 |
| 6,174,150 | B1 | 1/2001 | Tsubono et al. | |
| 6,244,834 | B1 | 6/2001 | Matsuda et al. | |
| 6,261,071 | B1 | 7/2001 | Williams et al. | |
| 6,293,776 | B1 | 9/2001 | Hahn et al. | |
| 6,352,418 | B1 | 3/2002 | Kohsokabe et al. | |
| 6,402,485 | B2 | 6/2002 | Hong et al. | |
| 6,474,964 | B2 | 11/2002 | De Bernardi et al. | |
| 6,685,441 | B2 | 2/2004 | Nam | |
| 6,709,244 | B2 | 3/2004 | Pham | |
| 6,736,607 | B2 | 5/2004 | Ginies et al. | |
| 7,108,494 | B2 | 9/2006 | Nam | |
| 7,147,443 | B2 | 12/2006 | Ogawa et al. | |
| 7,207,787 | B2 | 4/2007 | Liang et al. | |
| 7,311,501 | B2 | 12/2007 | Wehrenberg et al. | |
| RE40,830 | E | 7/2009 | Caillat | |
| 7,699,589 | B2 | 4/2010 | Terauchi et al. | |
| 7,708,536 | B2 * | 5/2010 | Ginies et al. | 418/55.6 |
| 7,771,180 | B2 | 8/2010 | Cho et al. | |
| 7,905,715 | B2 | 3/2011 | Hiwata et al. | |
| 8,133,043 | B2 | 3/2012 | Duppert | |
| 2009/0229303 | A1 | 9/2009 | Iversen et al. | |
| 2012/0134859 | A1 | 5/2012 | Duppert | |
| 2012/0148433 | A1 | 6/2012 | Liang et al. | |
| 2013/0039792 | A1 | 2/2013 | Hiratsuka et al. | |
| 2013/0089451 | A1 | 4/2013 | Ahn et al. | |
| 2013/0108496 | A1 | 5/2013 | Nakai et al. | |
| 2013/0129549 | A1 | 5/2013 | Sakuda et al. | |

OTHER PUBLICATIONS

Written Opinion of the International Searching Authority regarding Application No. PCT/US/2012/056067, mailed Feb. 19, 2013.

* cited by examiner

DIRECT-SUCTION COMPRESSOR

CROSS-REFERENCE TO RELATED APPLICATIONS

This application claims the benefit of U.S. Provisional Application No. 61/541,494, filed on Sep. 30, 2011. The entire disclosure of the above application is incorporated herein by reference.

FIELD

The present disclosure relates to a compressor, and more particularly to a direct-suction compressor.

BACKGROUND

This section provides background information related to the present disclosure and is not necessarily prior art.

A compressor may be incorporated into a heating and/or cooling system and may include a shell containing a compression mechanism and a motor driving the compression mechanism. In many compressors, the shell defines a suction chamber into which a relatively low-pressure fluid is drawn. The motor and the compression mechanism may be disposed in the suction chamber. The low-pressure fluid drawn into the suction chamber may absorb heat from the motor before being drawn into the compression mechanism. Cooling the motor in this manner can improve the efficiency and longevity of the motor, but also elevates a temperature of the fluid which may hinder a heating and/or cooling capacity or efficiency of the system.

SUMMARY

This section provides a general summary of the disclosure, and is not a comprehensive disclosure of its full scope or all of its features.

In one form, the present disclosure provides a compressor that may include a shell, a compression mechanism, and a suction passageway. The shell may include an inlet port. The compression mechanism may be disposed within the shell and may include a suction inlet. The suction passageway may include a first portion, a second portion, and an intermediate portion. The first portion may be fluidly coupled to the inlet port. The second portion may be fluidly coupled to the suction inlet of the compression mechanism. The intermediate portion may be disposed between the first and second portions and may be movable between a first position in which the intermediate portion engages the first and second portions and a second position in which the intermediate portion is disengaged from at least one of the first and second portions.

In some embodiments, the intermediate portion may include a first end engaging the first portion in the first position and a second end engaging the second portion in the first position. The first end may be spaced apart from the first portion in the second position to define a leakage path therebetween.

In some embodiments, the shell may define a chamber in which the compression mechanism and the intermediate portion are disposed. Suction gas may be received in the suction passageway is fluidly isolated from the chamber when the intermediate portion is in the first position and an entire flow of suction gas entering the first portion of the suction passageway flows into the chamber prior to entering the suction inlet of the compression mechanism.

In some embodiments, the intermediate portion may be movable to a third position between the first and second positions allowing a portion of suction gas entering the suction passageway to flow directly to the suction inlet of the compression mechanism and another portion of suction gas to flow into the chamber.

In some embodiments, the compressor may include a motor disposed within the shell and driving the compression mechanism. Suction gas may flow into a chamber defined by the shell when the intermediate portion is in the second position and absorbs heat from the motor.

In some embodiments, the intermediate portion may include a fluid deflector extending from an outer surface thereof. The fluid deflector may deflect fluid exiting the first portion of the suction passageway toward a motor of the compressor when the intermediate portion is in the second position.

In some embodiments, the inlet port of the shell and the suction inlet of the compression mechanism may be axially misaligned from each other.

In some embodiments, the compressor may include an actuator connected to the intermediate portion. The actuator may move the intermediate portion between the first and second positions.

In some embodiments, the intermediate portion includes a generally tubular member.

In some embodiments, the suction passageway includes a hinge connected to the intermediate portion and one of the first and second portions. The intermediate portion may pivot about the hinge between the first and second positions.

In another form, the present disclosure provides a compressor that may include a shell, a compression mechanism, a conduit and an actuation device. The shell may include an inlet port and may define a chamber. The compression mechanism may be disposed within the chamber and may include a suction inlet. The conduit may include a first portion fluidly coupled to the inlet port and a second portion fluidly coupled to the suction inlet of the compression mechanism. The actuation device may be associated with the conduit and may be movable between first position causing fluid within the conduit to be isolated from the chamber and a second position causing fluid from the first portion of the conduit to be deflected into the chamber before the fluid enters the suction inlet of the compression mechanism.

In some embodiments, the actuation device may be connected to a third portion of the conduit. The third portion may be in fluid communication with the first and second portions when the actuation device is in the first position. The third portion may be decoupled from at least one of the first and second portions when the actuation device is in the second position.

In some embodiments, the conduit may include a hinge connected to the third portion and one of the first and second portions. The third portion may pivot about the hinge between the first and second positions. In some embodiments, a deflector may extend from the third portion and deflect fluid toward a motor driving the compression mechanism when the actuation device is in the second position.

In some embodiments, the actuation device may be operatively connected to a valve member disposed in the conduit. In some embodiments, the valve member may restrict or prevent fluid communication between the first portion of the conduit and a distribution conduit when the actuation device is in the first position and allow fluid communication between the first portion of the conduit and the distribution conduit when the actuation device is in the second position.

In some embodiments, the valve member may restrict or prevent fluid communication between the second portion of the conduit and a return conduit when the actuation device is in the first position and allow fluid communication between the second portion and the return conduit when the actuation device is in the second position to transmit fluid from the chamber to the second portion when the actuation device is in the second position.

In some embodiments, the actuation device may include an axially rigid link member coupled to the valve member.

In some embodiments, the actuation device may be movable to a third position between the first and second positions allowing a portion of fluid entering the conduit to flow directly to the suction inlet of said compression mechanism and another portion of fluid to flow into the chamber.

In some embodiments, the first and second portions of the conduit may be substantially axially aligned with each other.

In some embodiments, substantially all of the fluid entering the first portion of said conduit enters the chamber prior to entering the suction inlet of the compression mechanism when the actuation device is in the second position.

In another form, the present disclosure provides a compressor that may include a motor, a compression mechanism, a conduit or passageway and a valve member. The motor may be disposed within a chamber. The compression mechanism may be driven by the motor and may include a suction inlet. The passageway may include a first portion in fluid communication with the suction inlet and a second portion in fluid communication with the chamber. The valve member may be disposed within the passageway and may be movable between a first position allowing fluid flow through the first portion of the passageway and restricting fluid flow through the second portion of the passageway and a second position allowing fluid flow through the second portion of the passageway and restricting fluid flow through the first portion of the passageway.

In some embodiments, the actuation device may be movable to a third position allowing fluid flow through the first and second portions of the passageway.

In some embodiments, the passageway may include a third portion receiving fluid from outside of the compressor. The third portion may be in fluid communication with the first portion when the valve member is in the first position and in fluid communication with the second portion when the valve member is in the second position. In some embodiments, the third portion may be fluidly isolated from the second portion when the valve member is in the first position.

In some embodiments, the conduit may extend through a structure axially supporting a movable member of the compression mechanism. In some embodiments, the movable member may be a non-orbiting scroll member. In some embodiments, the structure may include a floating seal assembly facilitating axial compliance of an orbiting scroll member of said compression mechanism.

In some embodiments, the passageway may extend at least partially through a non-orbiting scroll member of the compression mechanism.

In some embodiments, the passageway may extend through a bearing-housing supporting a crankshaft driving the compression mechanism.

In some embodiments, the passageway may include a return portion receiving fluid from the second portion and supplying fluid to the suction inlet. In some embodiments, the return portion may extend through a structure axially supporting a movable member of the compression mechanism. In some embodiments, the movable member may be a non-orbiting scroll member. In some embodiments, the motor may be disposed between an inlet of the return portion and an outlet of the second portion.

In some embodiments, the compressor may include a thermally actuated device connected to the valve member and in thermal communication with the motor. The thermally actuated device may move the valve member from the first position to the second position in response to the motor reaching a predetermined temperature. In some embodiments, a spring member may bias the valve member toward the first position.

In some embodiments, the passageway may be formed in at least one of a non-orbiting scroll member of the compression mechanism, a bearing-housing rotatably supporting a crankshaft, and a structure axially supporting an orbiting scroll member of the compression mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
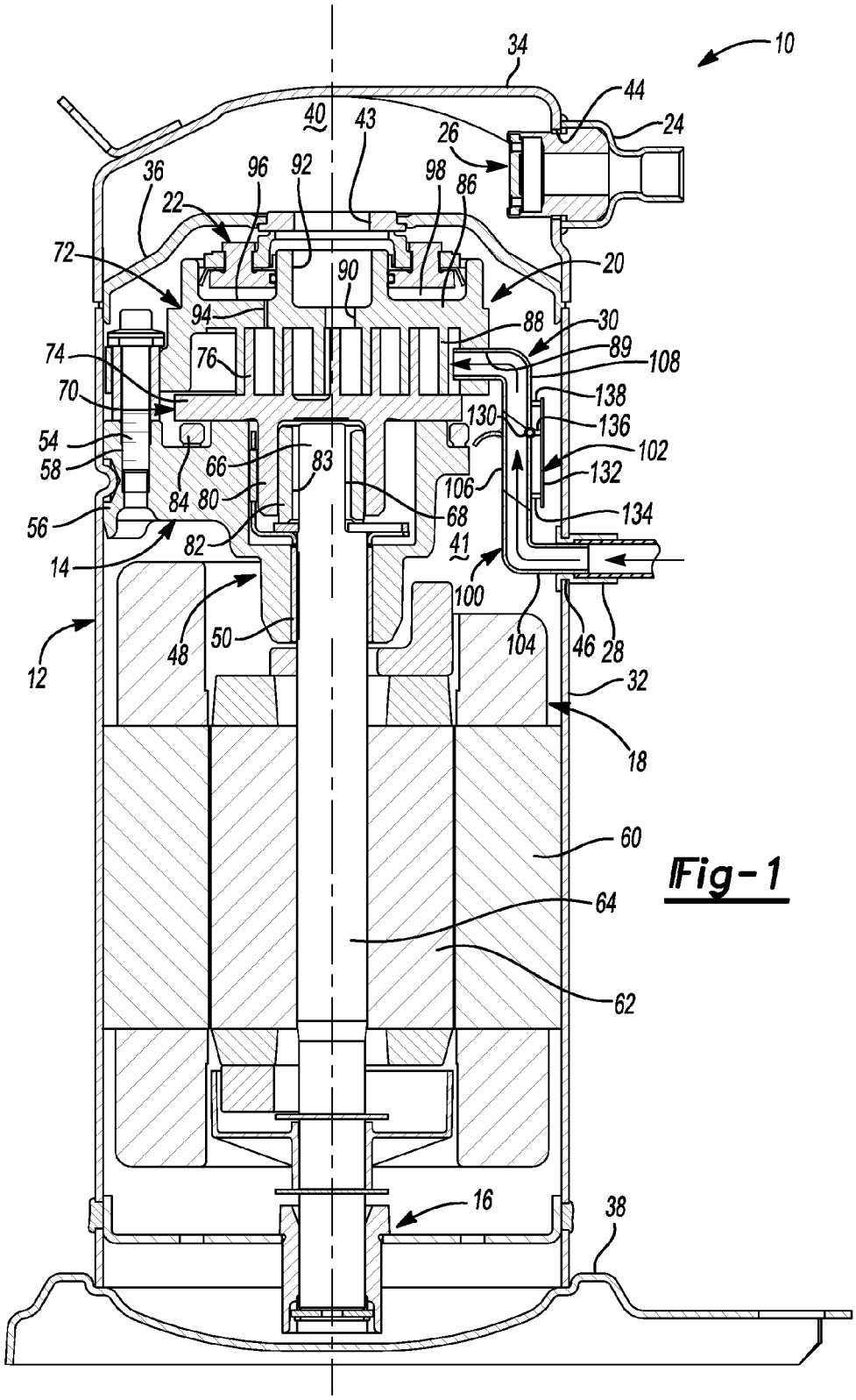
FIG. 1 is a cross-sectional view of a compressor including a suction conduit assembly in a first state according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 3:
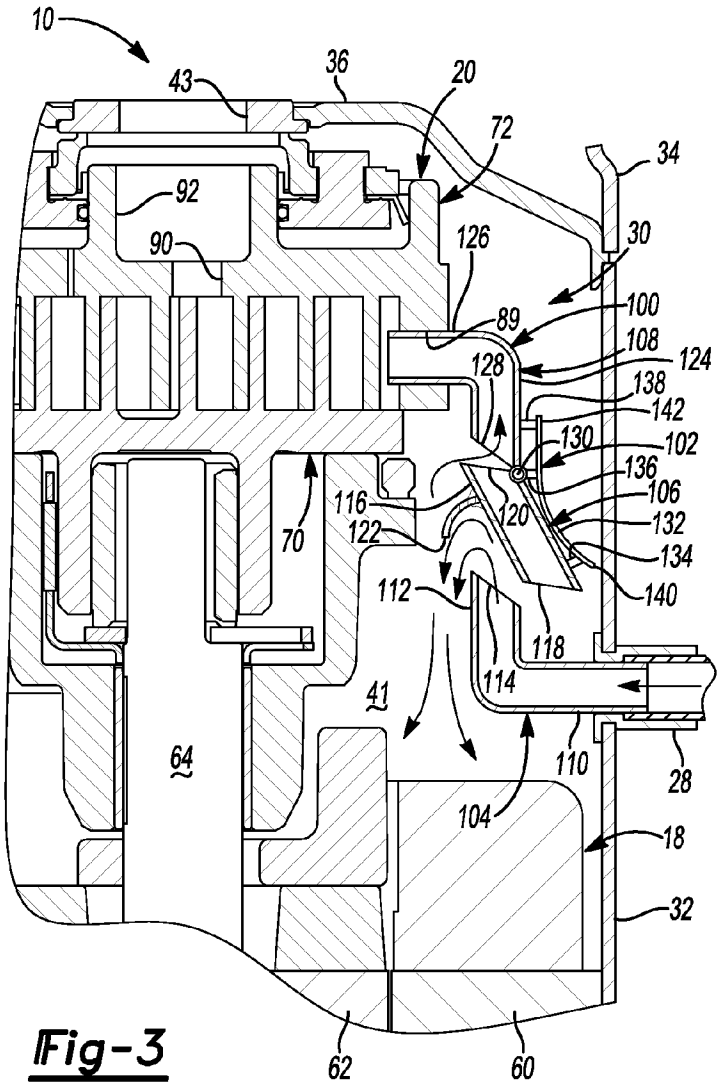
FIG. 3 is a partial cross-sectional view of the compressor of FIG. 1 with the suction conduit assembly in a third state according to the principles of the present disclosure.
Figure 2:
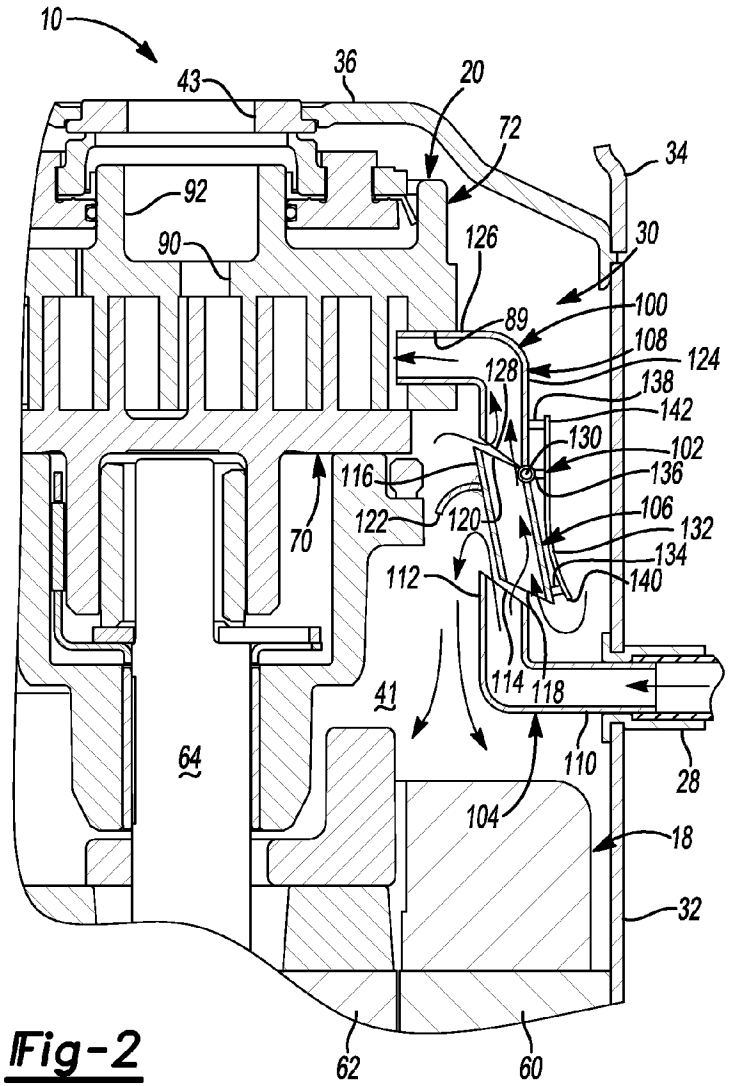
FIG. 2 is a partial cross-sectional view of the compressor of FIG. 1 with the suction conduit assembly in a second state according to the principles of the present disclosure.

With reference to FIGS. 1-3, a compressor 10 is provided and may include a hermetic shell assembly 12, first and second bearing-housing assemblies 14, 16, a motor assembly 18, a compression mechanism 20, a seal assembly 22, a discharge port or fitting 24, a discharge valve assembly 26, a suction port or fitting 28, and a suction conduit assembly 30.

The shell assembly 12 may form a compressor housing and may include a cylindrical shell 32, an end cap 34 at an upper end thereof, a transversely extending partition 36, and a base 38 at a lower end thereof. The end cap 34 and the partition 36 may define a discharge chamber 40. The partition 36 may separate the discharge chamber 40 from a suction chamber 41. A discharge passage 43 may extend through the partition 36 to provide communication between the compression mechanism 20 and the discharge chamber 40. The discharge fitting 24 may be attached to shell assembly 12 at an opening 44 in the end cap 34. The discharge valve assembly 26 may be disposed within the discharge fitting 24 and may generally prevent a reverse flow condition. The suction fitting 28 may be attached to shell assembly 12 at an opening 46.

The first bearing-housing assembly 14 may be fixed relative to the shell 32 and may include a main bearing-housing 48, a first bearing 50, and fastener assemblies 54. The main bearing-housing 48 may house the first bearing 50 therein. The main bearing-housing 48 may include a plurality of radially extending arms 56 engaging the shell 32. Apertures 58 extending through the arms 56 may receive the fastener assemblies 54.

The motor assembly 18 may include a motor stator 60, a rotor 62, and a drive shaft 64. The motor stator 60 may be press fit into the shell 32. The rotor 62 may be press fit on the drive shaft 64 and may transmit rotational power to the drive shaft 64. The drive shaft 64 may be rotatably supported by the first and second bearing-housing assemblies 14, 16. The drive shaft 64 may include an eccentric crank pin 66 having a flat 68 thereon.

The compression mechanism 20 may include an orbiting scroll 70 and a non-orbiting scroll 72. The orbiting scroll 70 may include an end plate 74 and a spiral wrap 76 extending therefrom. A cylindrical hub 80 may project downwardly from the end plate 74 and may include a drive bushing 82 disposed therein. The drive bushing 82 may include an inner bore 83 in which the crank pin 66 is drivingly disposed. The crank pin flat 68 may drivingly engage a flat surface in a portion of the inner bore 83 to provide a radially compliant driving arrangement. An Oldham coupling 84 may be engaged with the orbiting and non-orbiting scrolls 70, 72 to prevent relative rotation therebetween.

The non-orbiting scroll 72 may include an end plate 86 and a spiral wrap 88 projecting downwardly from the end plate 86. The spiral wrap 88 may meshingly engage the spiral wrap 76 of the orbiting scroll 70, thereby creating a series of moving fluid pockets. The fluid pockets defined by the spiral wraps 76, 88 may decrease in volume as they move from a radially outer position (at a suction pressure) to a radially intermediate position (at an intermediate pressure) to a radially inner position (at a discharge pressure) throughout a compression cycle of the compression mechanism 20. A suction inlet 89 may be formed in the non-orbiting scroll 72 and may provide fluid communication between the suction conduit assembly 30 and a radially outermost fluid pocket formed by the spiral wraps 76, 88. In some embodiments, the suction fitting 28 may be axially misaligned with the suction inlet 89. For example, the suction fitting 28 may be disposed vertically lower than the suction inlet 89, as shown in FIGS. 1-3. In other embodiments, the suction inlet 89 and the suction fitting 28 could be substantially axially aligned with each other (i.e., at the same vertical height).

The end plate 86 may include a discharge passage 90, a discharge recess 92, an intermediate passage 94, and an annular recess 96. The discharge passage 90 is in communication with one of the fluid pockets at the radially inner position and allows compressed working fluid (at the discharge pressure)

to flow through the discharge recess 92 and into the discharge chamber 40. The intermediate passage 94 may provide communication between one of the fluid pockets at the radially intermediate position and the annular recess 96. The annular recess 96 may encircle the discharge recess 92 and may be substantially concentric therewith.

The annular recess 96 may at least partially receive the seal assembly 22 and may cooperate with the seal assembly 22 to define an axial biasing chamber 98 therebetween. The biasing chamber 98 receives fluid from the fluid pocket in the intermediate position through the intermediate passage 94. A pressure differential between the intermediate-pressure fluid in the biasing chamber 98 and fluid in the suction chamber 41 exerts a net axial biasing force on the non-orbiting scroll 72 urging the non-orbiting scroll 72 toward the orbiting scroll 70. In this manner, the tips of the spiral wrap 88 of the non-orbiting scroll 72 are urged into sealing engagement with the end plate 74 of the orbiting scroll 70 and the end plate 86 of the non-orbiting scroll 72 is urged into sealing engagement with the tips of the spiral wrap 76 of the orbiting scroll 70.

The suction conduit assembly 30 may include a suction passageway 100 and an actuation device 102. The suction passageway 100 may be a conduit extending between adjacent arms 56 of the main bearing-housing 48 and fluidly coupling the suction fitting 28 and the suction inlet 89. The suction passageway 100 may be formed from one or more metallic and/or polymeric materials, for example, and may include a first portion 104, a second portion 106, and a third portion 108. The first, second, and third portions 104, 106, 108 can be generally tubular members, for example. The first portion 104 may be a generally L-shaped conduit having first and second legs 110, 112. The first leg 110 may engage the suction fitting 28 for fluid communication therebetween. The second leg 112 may include a distal end 114 that is angled relative to a longitudinal axis of the second leg 112.

The second portion 106 may include an outer circumferential surface 116 and first and second distal ends 118, 120. The second portion 106 may be movable relative to the first and third portions 104, 108 among a direct-suction position (FIG. 1), a motor-cooling position (FIG. 3), and an intermediate position (FIG. 2). The first and second ends 118, 120 may be angled relative to the outer circumferential surface 116 and may be substantially parallel to the distal end 114 of the first portion 104. In this manner, the first distal end 118 may matingly engage the distal end 114 so that the first and second portions 104, 106 cooperate to form a substantially uninterrupted fluid passageway when the second portion 106 is in the direct-suction position, as shown in FIG. 1.

A deflector 122 may extend outward from the outer circumferential surface 116 toward a longitudinal axis of the compressor 10. The deflector 122 may be angled and/or curved downward generally toward the motor assembly 18. The deflector 122 can be integrally formed with the second portion 106 or attached thereto via one or more fasteners, an adhesive, and/or any other suitable means. The deflector 122 may be positioned on the second portion 106 such that at least a portion of fluid that exits the first portion 104 when the second portion 106 is in the intermediate position or the motor-cooling position may be deflected off of the deflector 122 downward toward the motor assembly 18 to cool components of the motor assembly 18, for example, and/or other components disposed within the suction chamber 41.

The third portion 108 may be a generally L-shaped conduit having first and second legs 124, 126. The first leg 124 may include a distal end 128 that is angled relative to a longitudinal axis of the first leg 124 to matingly engage the second distal end 120 of the second portion 106 when the second portion 106 is in the direct-suction position. The second leg 126 may sealingly engage the suction inlet 89 of the non-orbiting scroll 72 for fluid communication between the third portion 108 and the fluid pockets defined by the orbiting and non-orbiting scrolls 70, 72.

A hinge 130 may engage the second portion 106 and the third portion 108 at or near the second distal end 120 of the second portion 106 and at or near the distal end 128 of the first leg 124. The hinge 130 could be secured to the second and third portions 106, 108 by any suitable means and could be any suitable type of hinge. In some embodiments, the hinge 130 could be a living hinge, for example. The hinge 130 may enable the second portion 106 to pivot relative to the first and third portions 104, 108 among the direct-suction, intermediate, and motor-cooling positions.

The actuation device 102 may include a reed member 132, a first support member 134, a second support member 136, and a third support member 138. The reed member 132 may include two or more reeds, strips or portions of dissimilar materials having different coefficients of thermal expansion. For example, the reed member 132 may include a steel reed and a bronze or copper reed brazed or otherwise joined together. Because the two reeds have different coefficients of thermal expansion, when the reed member 132 is exposed to heat (e.g., from the motor assembly 18), the differing rates of thermal expansion causes the reed member 132 to bend.

The first support member 134 may extend between a first end 140 of the reed member 132 and the outer circumferential surface 116 of the second portion 106 of the suction passageway 100 at or near the first distal end 118, for example. The second support member 136 may extend between the reed member 132 and the hinge 130, for example. The third support member 138 may extend between a second end 142 of the reed member 132 and the first leg 124 of the third portion 108 of the suction passageway 100.

In some embodiments, the actuation device 102 could include any other type of actuator such as a stepper motor or a solenoid, for example, configured to pivot the second portion 106 among the direction-suction, intermediate, and motor-cooling positions. In such embodiments, the actuation device 102 may be in electrical communication with one or more temperature sensors located in one or more locations in the suction chamber 41 and/or a control module operable to send an electrical signal to the actuation device 102 to move the second portion 106.

With continued reference to FIGS. 1-3, operation of the compressor 10 will be described in detail. During operation of the compressor 10, electrical power may be supplied to the motor assembly 18, causing the rotor 62 to rotate and turn the drive shaft 64, which in turn causes the orbiting scroll 70 to orbit relative to the non-orbiting scroll 72. Orbital motion of the orbiting scroll 70 relative to the non-orbiting scroll 72 generates a vacuum at the suction inlet 89 which causes fluid from outside of the shell assembly 12 to be drawn into the compressor 10 through the suction fitting 28 and into the first portion 104 of the suction passageway 100.

When the suction passageway 100 is in the direct-suction position (FIG. 1), the fluid may flow from the first portion 104 directly into the second portion 106, then directly into the third portion 108, and then directly into the fluid pocket formed between the orbiting and non-orbiting scrolls 70, 72. The second portion 106 may be substantially sealed to the first and third portions 104, 108 in the direct-suction position, and therefore, fluid flowing through the suction passageway 100 when the second portion 106 is in the direct-suction position may be substantially isolated from the suction chamber 41. In this manner, the fluid drawn into the compression mechanism 20 will absorb relatively little heat from the motor assembly 18 and/or other components disposed within the suction chamber 41. Because the fluid is not heated by these components prior to being compressed in the compression mechanism 20, the fluid is not as hot as it otherwise would be when it is discharged through the discharge fitting 24. In this manner, the system in which the compressor 10 is incorporated can operate more efficiently.

Prolonged operation of the motor assembly 18 and/or operation of the motor assembly 18 under high load conditions may increase the temperature of the motor assembly 18. The actuation device 102 may be disposed within the general proximity of the motor assembly 18 such that the heat from the motor assembly 18 may be convectively transferred to the reed member 132.

As described above, the reed member 132 may bend in response to an increase in temperature in the suction chamber 41. Because the third portion 108 of the suction passageway 100 is fixed relative to the non-orbiting scroll 72, when the reed member 132 bends in response to an increase in temperature in the suction chamber 41, the first end 140 of the reed member 132 may bend outward relative to the first and third portions 104, 108 toward the shell 32, thereby causing the second portion 106 to pivot about the hinge 130 from the direct-suction position (FIG. 1) to the motor-cooling position (FIG. 3) or to any position therebetween (e.g., the intermediate position shown in FIG. 2).

As the second portion 106 pivots from the direct-suction position toward the intermediate position, the first distal end 118 of the second portion 106 separates from the distal end 114 of the first portion 104, and the second distal end 120 of the second portion 106 separates from the distal end 128 of the third portion 108. Therefore, when the second portion 106 is in the intermediate position, a first portion of the fluid in the first portion 104 may flow out of the suction passageway 100 and into the suction chamber 41 and a second portion of the fluid in the first portion 104 may flow directly into the second portion 106 and directly through to the third portion 108 and into the compression mechanism 20. The first portion of the fluid exiting the suction passageway 100 between the distal end 114 and the first distal end 118 of the second portion 106 may be guided downward by the deflector 122 around the motor assembly 18 toward the base 38 of the shell assembly 12. The fluid flowing from the first portion 104 into the suction chamber 41 may be at a relatively low temperature and may absorb heat from the motor assembly 18 before it is drawn back up into the third portion 108 of the suction passageway 100 between the distal end 128 and the second end 120 of the second portion 106. In this manner, in the intermediate position, the first portion of the fluid flows into the suction chamber 41 to cool the motor assembly 18 while the second portion of the fluid may flow substantially directly into the compression mechanism 20 absorbing little or no heat from the components in the suction chamber 41.

The amount of bending of the reed member 132 is based on the temperature surrounding the reed member 132 such that bending of the reed member 132 increases as the temperature surrounding the reed member 132 increases. Therefore, as long as the temperature of the motor assembly 18 continues to rise, the actuation device 102 will continue to pivot the second portion 106 of the suction passageway 100 toward the motor-cooling position shown in FIG. 3. In the motor-cooling position, all of or substantially all of the fluid in the first portion 104 may flow out of the suction passageway 100 to circulate around the suction chamber 41 and cool the motor assembly 18 before being drawn back into the third portion 108 and into the compression mechanism 20.

As the motor assembly 18 cools, the resultant decrease in temperature of fluid in the suction chamber 41 causes the reed member 132 to bend back toward the position shown in FIG. 1, thereby causing the second portion 106 of the suction passageway 100 to pivot back toward the direct-suction position.

Figure 4:
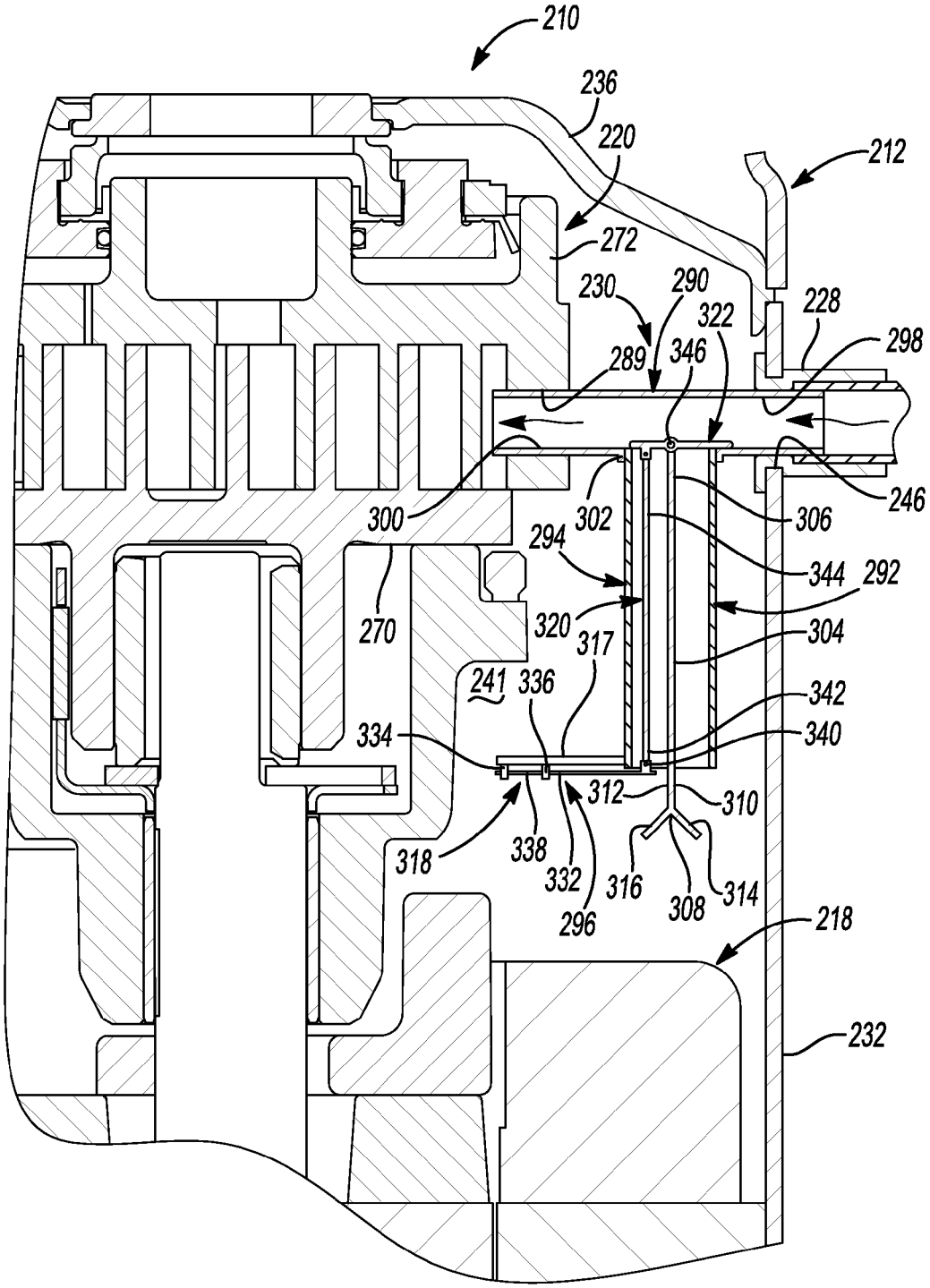
FIG. 4 is a partial cross-sectional view of another compressor including a suction conduit assembly in a first state according to the principles of the present disclosure.
Figure 6:
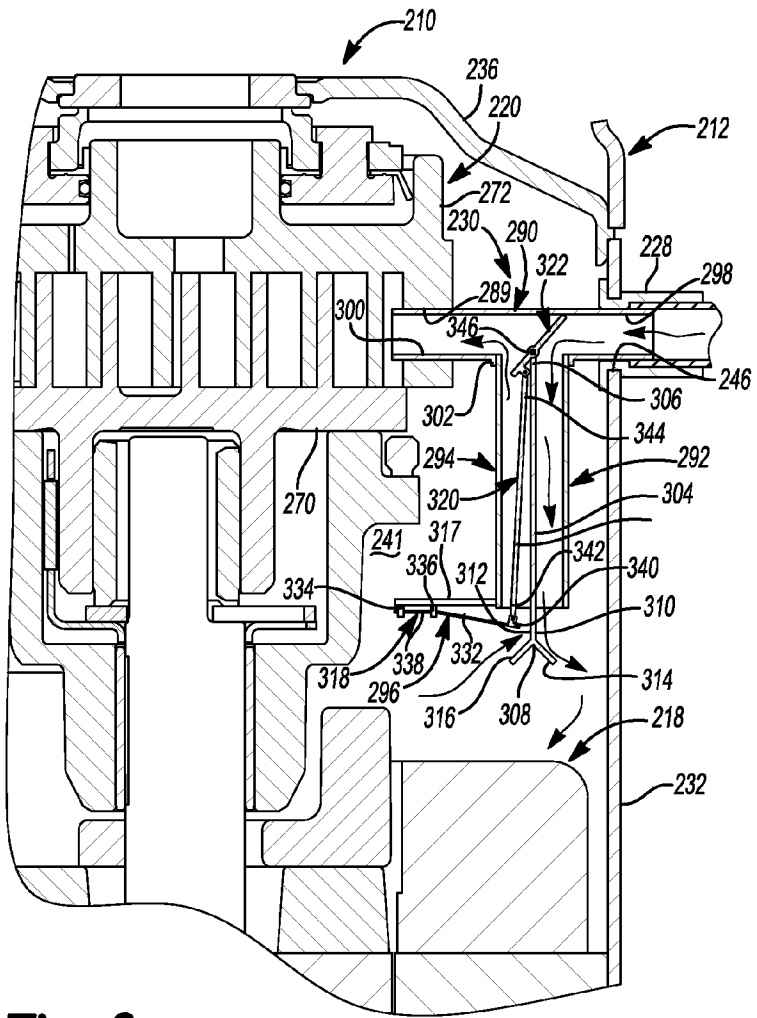
FIG. 6 is a partial cross-sectional view of the compressor of FIG. 4 with the suction conduit assembly in a third state according to the principles of the present disclosure.
Figure 5:
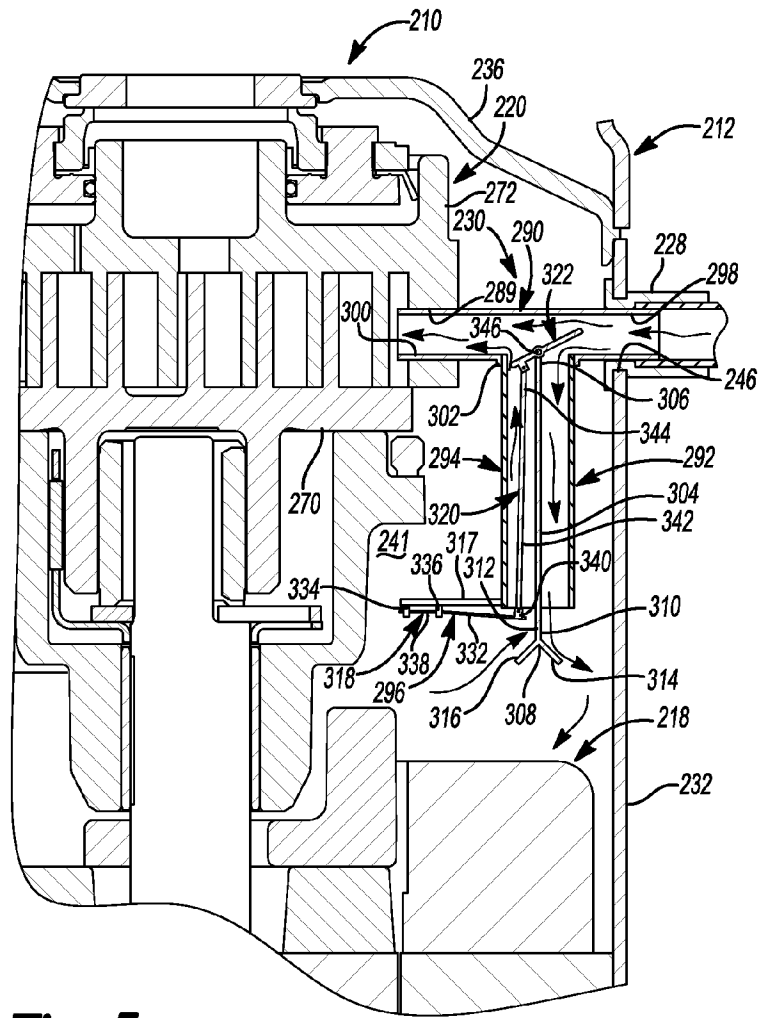
FIG. 5 is a partial cross-sectional view of the compressor of FIG. 4 with the suction conduit assembly in a second state according to the principles of the present disclosure.

With reference to FIGS. 4-6, another compressor 210 is provided. The structure and function of the compressor 210 may be substantially similar to that of the compressor 10, apart from any differences described below. Therefore, similar features will not be described again in detail. Briefly, the compressor 210 may include a hermetic shell assembly 212, a motor assembly 218, a compression mechanism 220, a suction port or fitting 228, and a suction conduit assembly 230. Like the shell assembly 12, the shell assembly 212 may include a cylindrical shell 232 and a partition 236 defining a suction chamber 241. The suction fitting 228 may engage an opening 246 in the shell 232. The compression mechanism 220 may include an orbiting scroll 270 and a non-orbiting scroll 272. The non-orbiting scroll 272 may include a suction inlet 289 through which suction gas is drawn into the fluid pockets defined by the orbiting and non-orbiting scrolls 270, 272. In some embodiments, the suction fitting 228 may be substantially axially aligned with the suction inlet 289, as shown in FIGS. 4-6, while in other embodiments, the suction fitting 228 could be axially misaligned with the suction inlet 289.

The suction conduit assembly 230 may include a suction passageway or conduit 290, a distribution passageway or conduit 292, a return passageway or conduit 294, and an actuation device 296. As will be subsequently described, the suction conduit assembly 230 may be operable in a direct-suction mode (FIG. 4), a motor-cooling mode (FIG. 6), and an intermediate mode (FIG. 5).

The suction conduit 290 may be a generally tubular member including a first portion 298, a second portion 300, and an intermediate outlet 302 disposed between the first and second portions 298, 300. The first portion 298 may sealing engage the suction fitting 228 for fluid communication therebetween. The second portion 300 may sealing engage the suction inlet 289 for fluid communication between the second portion 300 and the compression mechanism 220.

The distribution conduit 292 and the return conduit 294 may cooperate to form a generally tubular member sealingly engaging the intermediate outlet 302 of the suction conduit 290 and extending downward therefrom toward the motor assembly 218. A divider member 304 may extend longitudinally between and partially define the distribution conduit 292 and the return conduit 294. The divider member 304 may include a first end 306 disposed at or near the intermediate outlet 302 and a second end 308 defining outlets 310, 312 of the distribution conduit 292 and the return conduit 294, respectively. The second end 308 may include a first deflector 314 and a second deflector 316.

The actuation device 296 may include a mounting platform 317, an actuator 318, a link member 320, and a valve member 322. The mounting platform 317 may extend laterally from a distal end of the return conduit 294, for example. The actuator 318 may be generally similar to the actuation device 102, for example, and may include a reed member 332, a first support member 334, and a second support member 336. The first and second support members 334, 336 may extend between the mounting platform 317 and the reed member 332. The reed member 332 may include two or more reeds, strips or portions of dissimilar materials having different coefficients of thermal expansion, as described above. The reed member 332 may include a first end 338 connected to the first and second support members 334, 336 and a second end 340 extending into the return conduit 294.

The link member 320 may be an axially rigid member including a first end 342 and a second end 344. The first end 342 of the link member 320 may be pivotably connected to the second end 340 of the reed member 332. The second end 344 of the link member 320 may be pivotably connected to the valve member 322.

The valve member 322 may be a disk pivotably mounted to the divider member 304 at a hinge 346. The reed member 332 and the link member 320 may cooperate to pivot the valve member 322 among a first position corresponding to the direct-suction mode (FIG. 4), a second position corresponding to the intermediate mode (FIG. 5), and a third position corresponding to the motor-cooling mode (FIG. 6). In the first position, the valve member 322 may restrict or prevent fluid communication between the suction conduit 290 and the distribution conduit 292 and between the suction conduit 290 and the return conduit 294. At least a portion of an outer periphery of the valve member 322 may include a resiliently flexible gasket (not specifically shown) that may seal-off the suction conduit 290 from the return conduit 294 in the first position. The flexible gasket may deflect to allow the valve member 322 to move from the first position to the second and third positions.

In the third position, the valve member 322 may restrict or prevent fluid in the first portion 298 of the suction conduit 290 from flowing directly into the second portion 300 of the suction conduit 290. In the second position, the valve member 322 may be disposed between the first and third positions and may allow direct fluid communication between the first and second portions 298, 300 of the suction conduit 290, direct fluid communication between the first portion 298 and the distribution conduit 292, and direct fluid communication between the return conduit 294 and the second portion 300.

With continued reference to FIGS. 4-6, operation of the suction conduit assembly 230 will be described in detail. As described above with respect to the compressor 10, during operation of the compressor 210, electrical power may be supplied to the motor assembly 218, causing the orbiting scroll 270 to orbit relative to the non-orbiting scroll 272. Orbital motion of the orbiting scroll 270 relative to the non-orbiting scroll 272 generates a vacuum at the suction inlet 289 which causes fluid from outside of the shell assembly 212 to be drawn into the compressor 210 through the suction fitting 228 and into the first portion 298 of the suction conduit 290.

When the actuation device 296 is in the first position (i.e., the suction conduit assembly 230 is in the direct-suction mode, as shown in FIG. 4), the fluid may flow from the first portion 298 directly into the second portion 300 and then directly into the fluid pocket formed between the orbiting and non-orbiting scrolls 270, 272. In the direct-suction mode, the valve member 322 may substantially seal-off the first and second portions 298, 300 from the distribution and return conduits 292, 294. Therefore, fluid flowing through the suction conduit 290 may be substantially isolated from the suction chamber 241 in the direct-suction mode. In this manner, the fluid drawn into the compression mechanism 220 will absorb relatively little or no heat from the motor assembly 218 and/or other components disposed within the suction chamber 241. This reduces the temperature of the fluid discharged from the compressor 210, thereby allowing the system in which the compressor 210 is incorporated to operate more efficiently.

As described above, prolonged operation of the motor assembly 218 and/or operation of the motor assembly 218 under high load conditions may increase the temperature of the motor assembly 218. The reed member 332 may be disposed within suction chamber 41 in the general proximity of the motor assembly 218 such that the heat from the motor assembly 218 may be convectively transferred to the reed member 332.

The reed member 332 may bend in response to an increase in temperature in the suction chamber 241. When the reed member 332 bends in response to an increase in temperature in the suction chamber 241, the second end 340 of the reed member 332 may bend downward relative to the mounting platform 317 toward the motor assembly 218, thereby pulling the link member 320 downward, causing the valve member 322 to pivot about the hinge 346 from the first position (FIG. 4) to the third position (FIG. 6) or to any position therebetween (e.g., the second position shown in FIG. 5).

When the valve member 322 is in the second position (i.e., the suction conduit assembly is in the intermediate mode), a first portion of the fluid in the first portion 298 of the suction conduit 290 may flow directly into the second portion 300 of the suction conduit 290 and directly into the compression mechanism 220, and a second portion of fluid in the first portion 298 may flow from the first portion 298 directly into the distribution conduit 292. The second portion of fluid may flow through the distribution conduit 292 and out of the outlet 310, where the first deflector 314 may guide the second portion of fluid toward the motor assembly 318 and away from the reed member 332 and the return conduit 294.

The fluid flowing around the motor assembly 218 may be at a relatively low temperature and may absorb heat from the motor assembly 218 before it is drawn back up into the return conduit 294. From the return conduit 294, the second portion of fluid may flow into the second portion 300 of the suction conduit 290 and into the compression mechanism 220. In this manner, in the intermediate mode, the first portion of the fluid may flow substantially directly into the compression mechanism 220 while the second portion of the fluid flows into the suction chamber 241 to cool the motor assembly 218 before being drawn into the compression mechanism 220.

The amount of bending of the reed member 332 is based on the temperature surrounding the reed member 332 such that bending of the reed member 332 increases as the temperature surrounding the reed member 332 increases. Therefore, as long as the temperature of the motor assembly 218 continues to rise, the valve member 322 will continue to pivot toward the third position shown in FIG. 6. In the third position (i.e., the motor-cooling mode), all of or substantially all of the fluid in the first portion 298 of the suction conduit 290 may flow through the distribution conduit 292 to circulate around the suction chamber 241 and cool the motor assembly 218 before being drawn back into the return conduit 294 and into the compression mechanism 220.

As the motor assembly 218 cools, the resultant decrease in temperature of the fluid in the suction chamber 241 causes the reed member 332 to bend back toward the position shown in FIG. 4, thereby causing the valve member 322 to pivot back toward the first position to return the suction conduit assembly 230 to the direct-suction mode.

Figure 7:
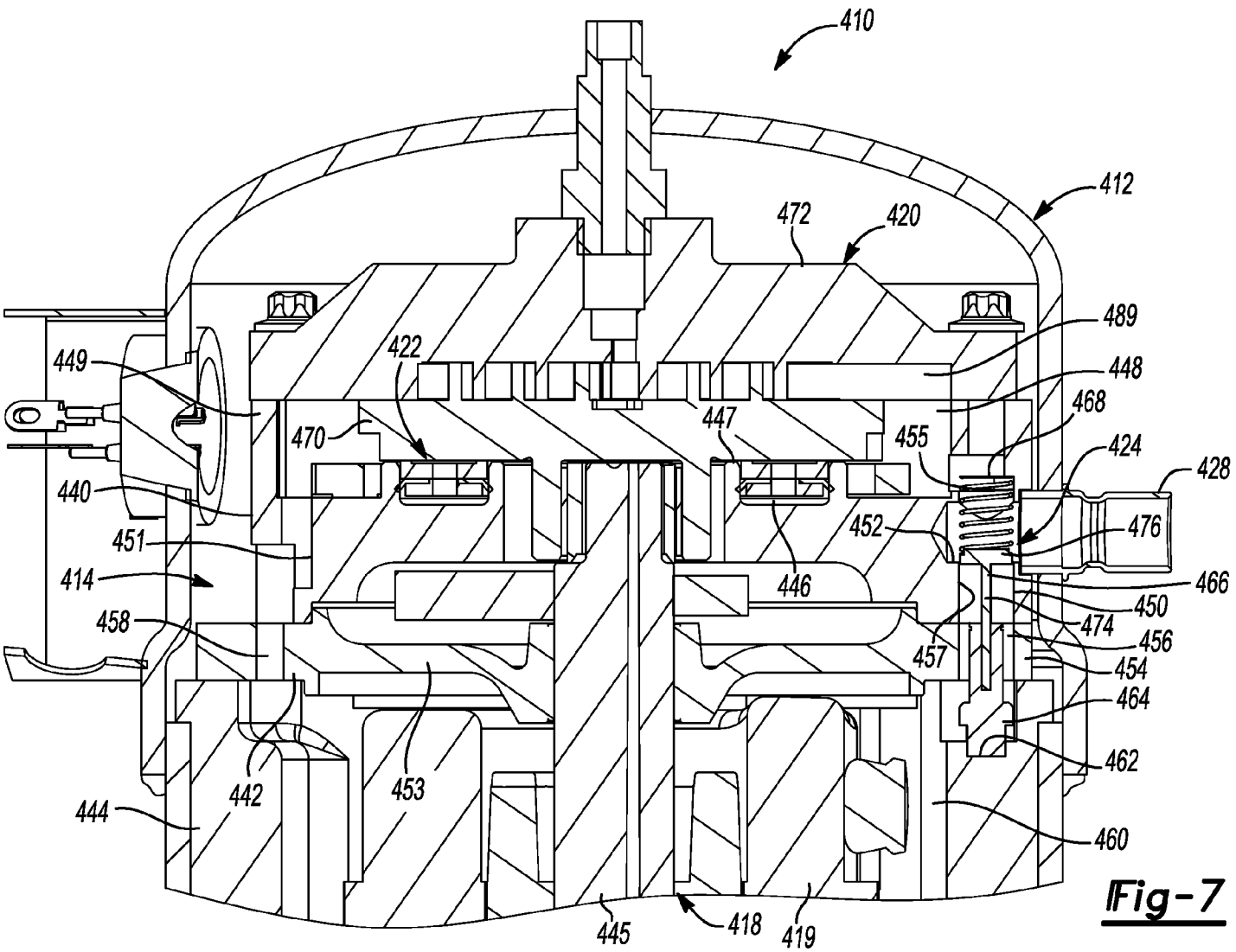
FIG. 7 is a partial cross-sectional view of yet another compressor including a suction conduit assembly in a first state according to the principles of the present disclosure.
Figure 8:
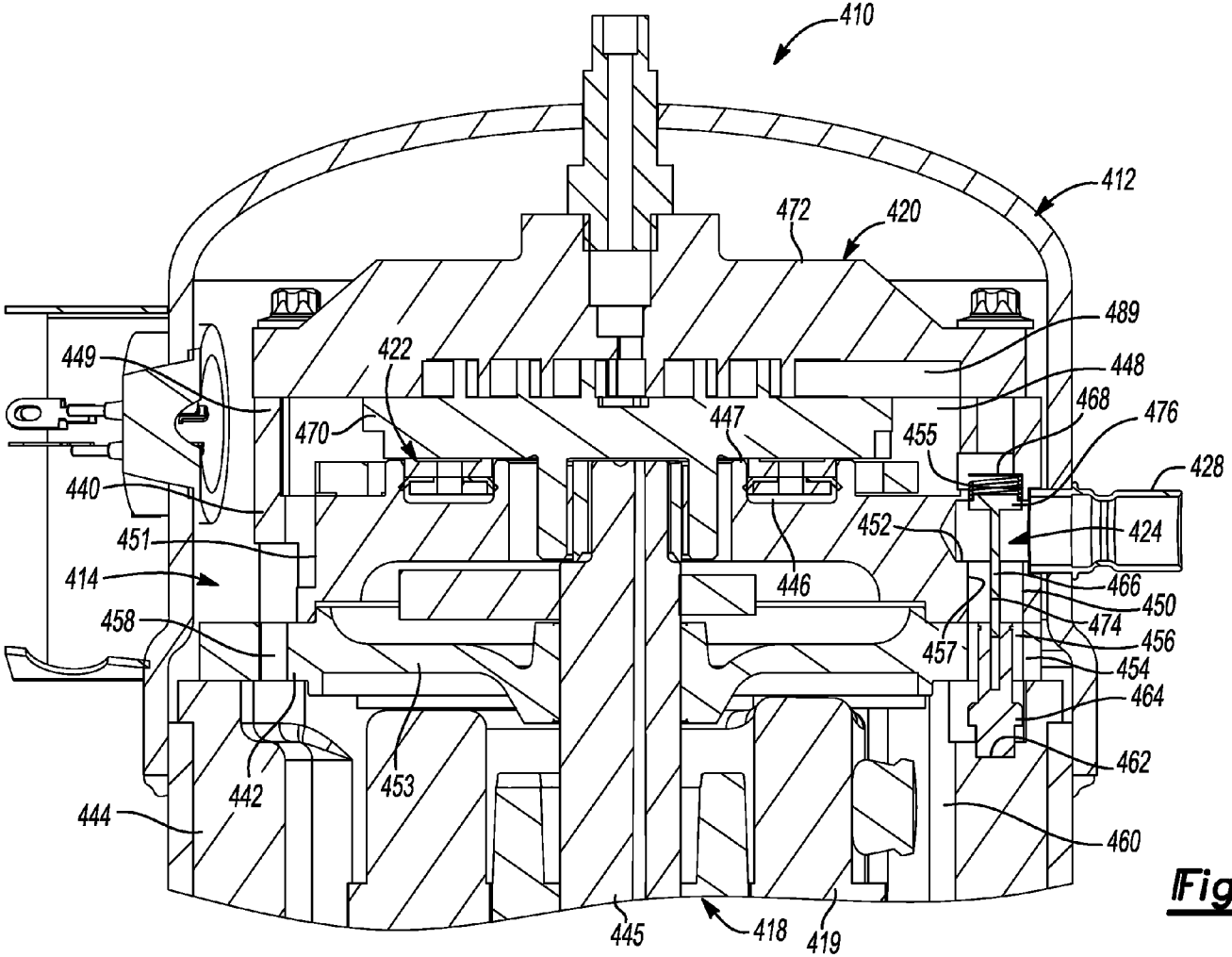
FIG. 8 is a partial cross-sectional view of the compressor of FIG. 7 with the suction conduit assembly in a second state according to the principles of the present disclosure.

With reference to FIGS. 7 and 8, another compressor 410 is provided. The structure and function of the compressor 410 may be generally similar to that of the compressor 10, apart from any differences described below and/or shown in the figures. Therefore, similar features will not be described again in detail. Briefly, the compressor 410 may include a hermetic shell assembly 412, a bearing assembly 414, a motor assembly 418, a compression mechanism 420, and a valve assembly 424. A suction fitting 428 may engage an opening in the shell assembly 412 and may provide suction-pressure fluid from outside of the compressor 410. The valve assembly 424 may direct the flow of suction-pressure fluid received into the compressor 410 through the suction fitting 428. The compression mechanism 420 may include an orbiting scroll 470 and a non-orbiting scroll 472. The non-orbiting scroll 472 may include a radially extending suction inlet 489 through which fluid is drawn into fluid pockets defined by the orbiting and non-orbiting scrolls 470, 472.

The bearing assembly 414 may include a first bearing-housing member 440, a first bearing 442, and a second bearing-housing member 444. The first bearing-housing member 440 and the first bearing 442 may be fixed relative to the second bearing-housing member 444. The first bearing-housing member 440 may be an annular member including a support surface 447 on an axial end surface thereof that may axially support the orbiting scroll 470 when the compressor 410 is shutdown.

The first bearing-housing member 440 may also include a first annular recess 446 and a second annular recess 448. The first annular recess 446 may receive a floating seal assembly 422 that axially biases the orbiting scroll 470 into engagement with the non-orbiting scroll 472 when the compressor 410 is operating. The second annular recess 448 may be defined by an outer rim 449 that axially supports the non-orbiting scroll 472. The second annular recess 448 may be in fluid communication with the suction inlet 489 formed in the non-orbiting scroll 472.

The first bearing-housing member 440 may also include a first aperture 450, a second aperture 451 and a third aperture 452. The first and second apertures 450, 451 may extend vertically through a lower end of the first bearing-housing member 440 and are in fluid communication with the second annular recess 448. The first aperture 450 may include a first portion 455 and a second portion 457. The first portion 455 may extend between the third aperture 452 and the second annular recess 448. The second portion 457 may extend from the third aperture 452 through the lower end of the first bearing-housing member 440. The second aperture 451 may be spaced about one-hundred-eighty degrees apart from the first aperture 450, for example. The third aperture 452 may extend radially outward from the first aperture 450 and may be fluidly coupled with the suction fitting 428 to provide fluid communication between the suction fitting 428 and the first aperture 450.

The first bearing 442 may be disposed between the first and second bearing-housing members 440, 444 and rotatably supports an upper end of a crankshaft 445 driven by the motor assembly 418. The first bearing 442 may include an annular body 453 and radially extending arms 454 fixed between the first and second bearing-housing members 440, 444. One of the radially extending arms 454 may include a fourth aperture 456 extending therethrough that may be in fluid communication with and axially aligned with the first aperture 450 in the first bearing-housing member 440. Another of the radially extending arms 454 may include a fifth aperture 458 extending therethrough that may be in fluid communication with and generally axially aligned with the second aperture 451 in the first bearing-housing member 440.

The second bearing-housing member 444 may be fixed to the shell assembly 412 and may house a second bearing (not shown) that rotatably supports a lower end (not shown) of the crankshaft 445. The second bearing-housing member 444 may axially support the first bearing 442. The second bearing-housing member 444 may fixedly support a stator 419 of the motor assembly 418 and may define a chamber 460 in which the motor assembly 418 may be disposed. The second bearing-housing member 444 may also include a recess 462 that may be axially aligned with and in communication with the fourth aperture 456 of the first bearing member 442. The chamber 460 may be in fluid communication with the recess 462 and the fourth and fifth apertures 456, 458.

The valve assembly 424 may include an actuator 464, a valve member 466 and a biasing member 468. The actuator 464 may be fixedly received in the recess 462 of the second bearing-housing member 444 and, in some embodiments, may extend into the fourth aperture 456 and the first aperture 450. The actuator 464 may slidably receive a stem 474 of the valve member 466. The actuator 464 may be a thermally activated actuator, for example, and may include a material that expands when exposed to heat from the motor assembly 418 or an electrical current from a controller (not shown), for example, to cause the stem 474 to move vertically upward relative to the actuator 464. The material of the actuator 464 may contract when cooled, thereby allowing the stem 474 to move vertically downward into the actuator 464. It will be appreciated that the actuator 464 could be any other type of actuator, such as a solenoid or any other electromechanical device.

The stem 474 of the valve member 466 may extend from the actuator 464 through the fourth aperture 456 and at least partially into the first aperture 450. A head 476 may be disposed on an upper end of the stem 474 and may engage the biasing member 468. The head 476 may be disposed in the third aperture 452 and may be movable with the stem 474 between a first position (FIG. 7) corresponding to a direct-suction mode and a second position (FIG. 8) corresponding to a motor-cooling mode. In the first position, the head 476 may seal-off the second portion 457 of the first aperture 450, thereby restricting or preventing fluid communication between the suction fitting 428 and the second portion 457 of the first aperture 450 and allowing fluid communication between the suction fitting 428 and the first portion 455 of the first aperture 450. In the second position, the head 476 may seal-off the first portion 455 of the first aperture 450, thereby restricting or preventing fluid communication between the suction fitting 428 and the first portion 455 of the first aperture 450 and allowing fluid communication between the suction fitting 428 and the second portion 457 of the first aperture 450. While not shown in the figures, the valve member 466 may be movable to one of a plurality of intermediate positions between the first and second positions to allow fluid communication between the suction fitting 428 and the first and second portions 455, 457. Fluid flow through the first and second portions 455, 457 may be varied by varying the position of the head 476 of the valve member 466 between the first and second positions.

With continued reference to FIGS. 7 and 8, operation of the compressor 410 will be described in detail. As described above with respect to the compressor 10, during operation of the compressor 410, electrical power may be supplied to the motor assembly 418, causing the orbiting scroll 470 to orbit relative to the non-orbiting scroll 472. Orbital motion of the orbiting scroll 470 relative to the non-orbiting scroll 472 generates a vacuum at the suction inlet 489 which causes fluid from outside of the shell assembly 412 to be drawn into the compressor 410 through the suction fitting 428 and into the first and third apertures 450, 452 in the first bearing-housing member 440.

When the valve member 466 is in the first position (FIG. 7), the compressor 410 may be operating in the direct-suction mode, whereby fluid entering the shell assembly 412 through the suction fitting 428 may flow into the first portion 455 of the first aperture 450 and may be restricted or prevented from flowing into the second portion 457 of the first aperture 450. Therefore, the fluid may flow from the first portion 455 to the second annular recess 448 and into the suction inlet 489 for compression in the compression mechanism 420. Therefore, fluid flowing entering the shell assembly 412 may be substantially isolated from the chamber 460 in the direct-suction mode. In this manner, the fluid drawn into the compression mechanism 420 will absorb relatively little or no heat from the motor assembly 418 and/or other components disposed within the chamber 460. This reduces the temperature of the fluid discharged from the compressor 410, thereby allowing the system in which the compressor 410 is incorporated to operate more efficiently.

As described above, prolonged operation of the motor assembly 418 and/or operation of the motor assembly 418 under high-load conditions may increase the temperature of the motor assembly 418. The actuator 464 of the valve assembly 424 may be in the general proximity of the motor assembly 418 such that the heat from the motor assembly 418 may be transferred to the actuator 464 (or transferred to a temperature sensor associated with the actuator 464). The actuator 464 may cause the valve member 466 to begin moving upward in response to exposure to a predetermined amount of heat.

When the valve member 466 is in one of the intermediate positions (i.e., a position between the first and second positions), a first portion of the fluid that enters the compressor 410 through the suction fitting 428 may flow into the first portion 455 of the first aperture 450 and into the second annular recess 448 and suction inlet 489, and a second portion of the fluid that enters the compressor 410 through the suction fitting 428 may flow into the second portion 457 of the first aperture 450. From the second portion 457, the fluid may flow into the fourth aperture 456 in the first bearing member 442 and into the chamber 460. In the chamber 460, the fluid may flow around the motor assembly 418 and absorb heat from the motor assembly 418 before it is drawn into the fifth aperture 458 and up to the second annular recess 448 through the second aperture 451. From the second annular recess 448, the fluid may flow into the suction inlet 489. In this manner, when the valve member 466 is in one of the intermediate positions, the first portion of the fluid may flow substantially directly into the compression mechanism 420 while the second portion of the fluid flows into the chamber 460 to cool the motor assembly 418 before being drawn into the compression mechanism 420.

When a temperature of the motor assembly 418 has caused the valve member 466 to be moved into the second position (FIG. 8), all of or a substantial majority of the fluid entering the compressor 410 through the suction fitting 428 may flow down through the second portion 457 of the first aperture 450, into the fourth aperture 456 and into the chamber 460 to circulate around the motor assembly 418 and cool the motor assembly 418 before being drawn back into the into the suction inlet 489 via the fifth aperture 458, the second aperture 451 and the second annular recess 448.

As the motor assembly 418 cools, the resultant decrease in temperature of fluid in the chamber 460 causes the actuator 464 to reduce or eliminate the application of upward force on the valve member 466, thereby allowing the biasing member 468 to move the valve member 466 to back toward the first position (FIG. 7).

While the compressors 10, 210, 410 are described above as being scroll compressors, the principles of the present disclosure could be incorporated into a rotary vane or reciprocating compressor, for example, or any other type of compressor.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell including an inlet port and defining a chamber;

a compression mechanism disposed within said chamber and including a suction inlet;

a motor driving said compression mechanism and disposed within said chamber;

a suction passageway including a first portion fluidly coupled to said inlet port, a second portion fluidly coupled to said suction inlet of said compression mechanism, and an intermediate portion disposed between said first and second portions and movable during operation of the compressor between a first position in which said intermediate portion engages said first and second portions and a second position in which said intermediate portion is disengaged from at least one of said first and second portions, wherein said chamber is fluidly isolated from said suction passageway when said intermediate portion is in said first position to prevent fluid communication between said chamber and said inlet port.

2. The compressor of claim 1, wherein the intermediate portion includes a first end engaging the first portion in the first position and a second end engaging the second portion in the first position, and wherein the first end is spaced apart from the first portion in the second position to define a leakage path therebetween.

3. The compressor of claim 1, wherein suction gas received in said suction passageway is fluidly isolated from said chamber when said intermediate portion is in said first position and an entire flow of suction gas entering said first portion of said suction passageway flows into said chamber prior to entering said suction inlet of said compression mechanism when said intermediate portion is in said second position.

4. The compressor of claim 3, wherein said intermediate portion is movable to a third position between said first and second positions allowing a portion of suction gas entering the suction passageway to flow directly to said suction inlet of said compression mechanism and another portion of suction gas to flow into said chamber.

5. The compressor of claim 1, wherein suction gas flows into said chamber defined by said shell when said intermediate portion is in said second position and absorbs heat from said motor.

6. The compressor of claim 1, wherein the intermediate portion includes a fluid deflector extending from an outer surface thereof, wherein said fluid deflector deflects fluid exiting said first portion of said suction passageway toward said motor of the compressor when the intermediate portion is in the second position.

7. The compressor of claim 1, further comprising an actuator connected to said intermediate portion, said actuator moving said intermediate portion between said first and second positions.

8. The compressor of claim 1, wherein said intermediate portion includes a generally tubular member.

9. The compressor of claim 1, wherein said suction passageway includes a hinge connected to said intermediate portion and one of said first and second portions, said intermediate portion pivoting about said hinge between said first and second positions.

10. A compressor comprising:

a shell including an inlet port;

a compression mechanism disposed within said shell and including a suction inlet;

a suction passageway including a first portion fluidly coupled to said inlet port, a second portion fluidly coupled to said suction inlet of said compression mechanism, and an intermediate portion disposed between said first and second portions and movable between a first position in which said intermediate portion engages said first and second portions and a second position in which said intermediate portion is disengaged from at least one of said first and second portions, wherein said suction passageway includes a hinge connected to said intermediate portion and one of said first and second portions, said intermediate portion pivoting about said hinge between said first and second positions.

11. The compressor of claim 10, wherein the intermediate portion includes a first end engaging the first portion in the first position and a second end engaging the second portion in the first position, and wherein the first end is spaced apart from the first portion in the second position to define a leakage path therebetween.

12. The compressor of claim 10, wherein the shell defines a chamber in which the compression mechanism and the intermediate portion are disposed, and wherein suction gas received in said suction passageway is fluidly isolated from said chamber when said intermediate portion is in said first position and an entire flow of suction gas entering said first portion of said suction passageway flows into said chamber prior to entering said suction inlet of said compression mechanism when said intermediate portion is in said second position.

13. The compressor of claim 12, wherein said intermediate portion is movable to a third position between said first and second positions allowing a portion of suction gas entering the suction passageway to flow directly to said suction inlet of said compression mechanism and another portion of suction gas to flow into said chamber.

14. The compressor of claim 10, further comprising a motor disposed within said shell and driving said compression mechanism, and wherein suction gas flows into a chamber defined by said shell when said intermediate portion is in said second position and absorbs heat from said motor.

15. The compressor of claim 10, wherein the intermediate portion includes a fluid deflector extending from an outer surface thereof, wherein said fluid deflector deflects fluid exiting said first portion of said suction passageway toward a motor of the compressor when the intermediate portion is in the second position.

16. The compressor of claim 10, further comprising an actuator connected to said intermediate portion, said actuator moving said intermediate portion between said first and second positions.

17. The compressor of claim 10, wherein said intermediate portion includes a generally tubular member.

18. A compressor comprising:

a shell including an inlet port and defining a chamber;

a compression mechanism disposed within said chamber and including a suction inlet;

a motor disposed within said chamber and driving said compression mechanism;

a conduit including a first portion fluidly coupled to said inlet port, a second portion fluidly coupled to said suction inlet of said compression mechanism;

an actuation device associated with said conduit and movable during operation of the compressor between a first position causing fluid within said conduit to be isolated from said chamber and a second position causing fluid from said first portion of said conduit to be deflected into said chamber before said fluid enters said suction inlet of said compression mechanism, wherein said chamber is fluidly isolated from an interior of said conduit when said actuation device is in said first position to prevent fluid communication between said chamber and said suction inlet.

19. The compressor of claim 18, wherein said actuation device is operatively connected to a valve member disposed in said conduit.

20. The compressor of claim 19, wherein said valve member restricts fluid communication between said first portion of said conduit and a distribution conduit when said actuation device is in said first position and allows fluid communication between said first portion of said conduit and said distribution conduit when said actuation device is in said second position.

21. The compressor of claim 20, wherein said valve member restricts fluid communication between said second portion of said conduit and a return conduit when said actuation device is in said first position and allows fluid communication between said second portion and said return conduit when said actuation device is in said second position to transmit fluid from said chamber to said second portion when said actuation device is in said second position.

22. The compressor of claim 21, wherein said actuation device includes an axially rigid link member coupled to said valve member.

23. The compressor of claim 18, wherein said actuation device is connected to a third portion of said conduit, and wherein said third portion is in fluid communication with said first and second portions when said actuation device is in said first position, and said third portion is decoupled from at least one of said first and second portions when said actuation device is in said second position.

24. The compressor of claim 23, wherein said conduit includes a hinge connected to said third portion and one of said first and second portions, said third portion pivoting about said hinge between said first and second positions.

25. The compressor of claim 18, wherein said actuation device is movable to a third position between said first and second positions allowing a portion of fluid entering said conduit to flow directly to said suction inlet of said compression mechanism and another portion of fluid to flow into said chamber.

26. The compressor of claim 18, wherein said first and second portions of said conduit are substantially axially aligned with each other.

27. The compressor of claim 18, wherein substantially all of said fluid entering said first portion of said conduit enters said chamber prior to entering said suction inlet of said compression mechanism when said actuation device is in said second position.

* * * * *